US007645555B2

(12) United States Patent
Lin et al.

(10) Patent No.: US 7,645,555 B2
(45) Date of Patent: Jan. 12, 2010

(54) PHOTORECEPTOR MEMBER

(75) Inventors: Liang-Bih Lin, Rochester, NY (US); Philip G. Perry, Webster, NY (US); Andronique Ioannidis, Webster, NY (US); William G. Herbert, Williamson, NY (US); David M. Skinner, Rochester, NY (US); Jin Wu, Webster, NY (US); Kendra Michele Giza, Webster, NY (US); Nancy Belknap, Rochester, NY (US); Yonn Rasmussen, Pittsford, NY (US); Geoffrey M. T. Foley, Fairport, NY (US); John F. Yanus, Webster, NY (US); Jennifer Y. Hwang, Penfield, NY (US); Robert P. Altavela, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/420,278

(22) Filed: Apr. 8, 2009

(65) Prior Publication Data

US 2009/0214978 A1 Aug. 27, 2009

Related U.S. Application Data

(62) Division of application No. 10/995,442, filed on Nov. 23, 2004, now Pat. No. 7,534,535.

(51) Int. Cl.
*G03G 5/00* (2006.01)

(52) U.S. Cl. ..... 430/131; 430/60; 430/63; 430/64; 430/69; 430/127

(58) Field of Classification Search ..... 430/127, 430/131, 60, 63, 64, 69
See application file for complete search history.

(56) References Cited

U.S. PATENT DOCUMENTS

| | | | | |
|---|---|---|---|---|
| 4,533,564 | A | 8/1985 | Kakinuma et al. | |
| 4,913,995 | A | 4/1990 | Chi et al. | |
| 4,921,769 | A * | 5/1990 | Yuh et al. | 430/64 |
| 5,013,624 | A | 5/1991 | Yu | |
| 5,063,125 | A | 11/1991 | Yuh et al. | |
| 5,104,756 | A | 4/1992 | Fukuda et al. | |
| 5,120,626 | A | 6/1992 | Fukuda et al. | |
| 5,132,200 | A | 7/1992 | Fukuda et al. | |
| 5,166,020 | A | 11/1992 | Fukuda et al. | |
| 5,397,666 | A | 3/1995 | Fukuda et al. | |
| 5,685,043 | A | 11/1997 | LaManna et al. | |
| 5,792,582 | A | 8/1998 | Yuh et al. | |
| 5,871,877 | A * | 2/1999 | Ong et al. | 430/58.8 |
| 5,874,193 | A * | 2/1999 | Liu et al. | 430/58.8 |
| 5,976,418 | A | 11/1999 | Fuller et al. | |
| 6,136,442 | A | 10/2000 | Wong | |

(Continued)

FOREIGN PATENT DOCUMENTS

JP 61200546 9/1986

OTHER PUBLICATIONS

Abstract of JP 61200546, Sep. 1986.

*Primary Examiner*—Hoa V Le
(74) *Attorney, Agent, or Firm*—Pillsbury Winthrop Shaw Pittman LLP

(57) ABSTRACT

An electrophotographic photoreceptor and method for forming a photoreceptor is disclosed which is provided with an anticorrosion layer on the interface between the supporting substrate surface and the undercoat layer. The photoreceptor has a high mechanical strength and minimizes defects in print for longer periods of time.

7 Claims, 2 Drawing Sheets

U.S. PATENT DOCUMENTS 6,205,307 B1 3/2001 Nukada et al.
6,245,420 B1 6/2001 Nishio et al.
6,245,473 B1 6/2001 Anayama et al.
6,261,214 B1 7/2001 Meguriya
6,261,729 B1 7/2001 Yuh et al.
6,287,737 B1 * 9/2001 Ong et al. ..... 430/58.8
6,290,342 B1 9/2001 Vo et al.
6,319,181 B1 11/2001 Naoi et al.
6,326,111 B1 12/2001 Chambers et al.
6,328,682 B1 12/2001 Shudo
6,328,922 B1 12/2001 Mishura et al.
6,336,982 B1 1/2002 Yu et al.
6,352,750 B1 3/2002 Kanetake
6,361,484 B1 3/2002 Chen et al.
6,365,280 B1 4/2002 Schlueter, Jr. et al.
6,406,784 B1 6/2002 Cerrah
6,444,386 B1 9/2002 Liu et al.
6,458,859 B2 10/2002 Hayashida et al.
6,461,701 B1 10/2002 Schlueter, Jr. et al.
6,472,078 B1 10/2002 Shudo et al.
6,481,995 B2 11/2002 Delrosario et al.
6,500,367 B2 12/2002 Naus et al.
6,521,332 B2 2/2003 Ciaschi et al.
6,558,767 B2 5/2003 Yuan et al.
6,558,781 B1 5/2003 Fuei et al.
6,571,939 B2 6/2003 Tamawskyij et al.
6,576,078 B2 6/2003 Mosher et al.
6,592,803 B2 7/2003 Nakazawa et al.
6,648,807 B2 11/2003 Hashimoto et al.
6,652,691 B1 11/2003 Yu et al.
6,660,351 B2 12/2003 Chen et al.
6,660,399 B1 12/2003 Kitano et al.
6,699,550 B2 3/2004 Suzuki et al.
6,790,571 B2 9/2004 Kawamura et al.
6,790,572 B2 9/2004 Tamoto et al.
6,790,573 B2 9/2004 Drappel et al.
6,790,574 B2 9/2004 Abe et al.
6,797,147 B2 9/2004 Dolan
6,802,951 B2 10/2004 Hossick-Schott
6,802,952 B2 10/2004 Hsu
6,803,639 B2 10/2004 Ono et al.
6,804,109 B1 10/2004 Hahn et al.
2002/0076631 A1 6/2002 Itami et al.
2006/0110671 A1 5/2006 Lin et al.

* cited by examiner

PHOTORECEPTOR MEMBER

CROSS REFERENCE TO RELATED APPLICATION

This application is a division of, and claims the benefit of priority to, U.S. patent application Ser. No. 10/995,442, filed Nov. 23, 2004, the disclosure of which is incorporated by reference in its entirety.

BACKGROUND

Disclosed is an imaging member, and processes for making imaging members. More specifically, illustrated and described herein is a photoreceptor and a process for making a photoreceptor for preventing or minimizing degradation or loss of integrity of the photoreceptor-substrate interface by incorporating in the photoreceptor an anti-corrosion layer and an undercoat layer.

An electrophotographic photoreceptor is a device used inside of a xerographic marking system on which a latent image is written by a laser or light emitting diode (LED) bar and then developed with a toner. A photoreceptor comprises for example, a photosensitive layer which may consist of multiple layers including, a charge transporting layer (CTL), a charge generating layer (CGL), an undercoat (UCL) or "blocking" layer, and a supporting substrate layer or base. An overcoat layer (OCL) may also be employed to coat the charge transport layer and protect the charge transport layer and extend the mechanical life of the photoreceptor, in some instances, as much as 10-fold over uncoated photoreceptors of the same make.

Photoreceptor devices under long, repeated use and high stress conditions, such as, high temperature, high relative humidity, and rapid cycling, degrade or lose integrity of the photoreceptor layers. The degradation of the layers of the photoreceptor is observed, for example, as black spots in prints which develop as a result of charge deficient spots and cyclic instability of the photoreceptor. Print defects associated with charge deficient spots, or black spots, are therefore, a major shortcoming in xerographic systems and usually attributed to electrical leakage across the photoreceptor layers at those spots. Although sources of such electrical leakage are multifold, electrical leakage frequently involves degradation of interfaces among the three active layers of the photoreceptor, i.e., undercoat layer, charge generating layer, and charge transporting layer, and in particular, between the undercoat layer and substrate. The degradation induces a conductive path transversal of the photoreceptor and causes the electrical leakage. To minimize degradation, most available methods are directed at improving the composition of the three active layers, individually. The interfaces between the component layers of the photoreceptors often have been ignored because they are inherently difficult to investigate.

Failure can be observed as black spots in prints due to charge deficient spots on photoreceptors was identified using transmission electron microscope analysis of a substrate.

Undercoat layers are used to provide an effective barrier against hole injection from the substrate. Undercoat layers need to permit efficient electron transport at interfaces, and in the bulk of the layer, provide plywood suppression, and provide a barrier against foreign material impaction, as well as have good adhesion properties.

Therefore, charge deficient spots and cyclic stability problems result primarily from degradation of the interface between substrate and undercoat layer. Thus, there is a need to produce photoreceptors which resist degradation of the photoreceptor layers in particular photoreceptors which maintain the integrity of the interface between the substrate and undercoat layer for a prolonged period of time so that the life of photoreceptor can be extended.

SUMMARY

Aspects disclosed herein include:

a process comprising applying an undercoat layer to a photoreceptor substrate, the undercoat layer comprising one or more layers, wherein at least one layer is an anti-corrosion layer.

Other features and advantages of the present disclosure will become apparent from the following detailed description, the accompanying drawings, and the appended claims.

DETAILED DESCRIPTION

Figure 1:
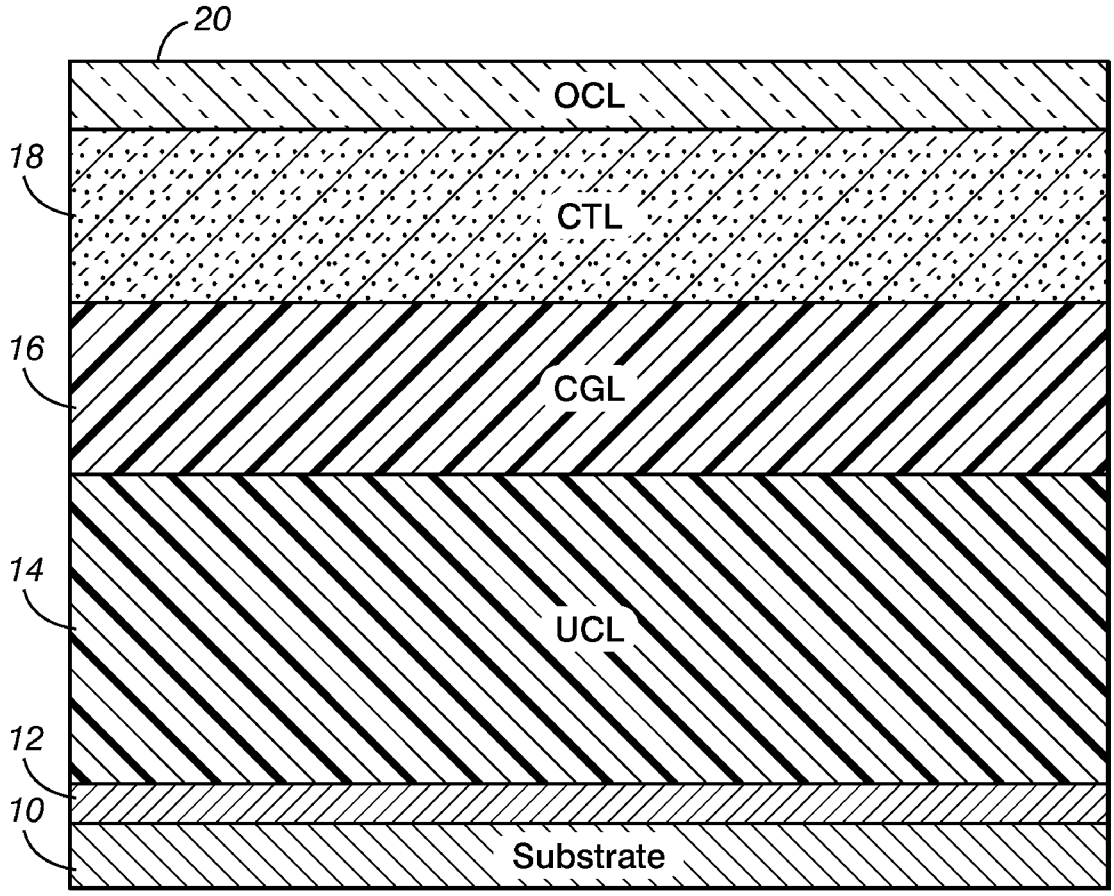
FIG. 1 is a schematic, cross-sectional view representation of an electrophotographic photoreceptor.

In embodiments there is illustrated:

a photoreceptor for use with a xerographic system comprising a substrate, an undercoat layer, a charge transport layer and a charge generating layer; the undercoat layer comprising an anti-corrosion layer. The xerographic system may comprise at least one of a laser, corona, and heat fuser.

The photoreceptor substrate, or supporting layer, may be comprised of a rigid or a flexible material and may have any number of different configurations such as a plate, a cylinder or drum, a sheet, a scroll, a flexible web, an endless flexible belt, and the like, and can be selected from various materials, including an electrically insulating or non-conductive material, such as inorganic or organic polymeric materials, such as MYLAR®, a commercially available polymer, MYLAR® containing titanium, a layer of an organic or material having a semiconductive surface layer, such as indium tin oxide, or aluminum arranged thereon, or a conductive material such as aluminum, aluminum alloys, titanium, titanium alloys, copper, copper iodide, brass, gold, zirconium, nickel, stainless steel, tungsten, chromium, or any other electrically conductive or insulating substance. The thickness of the substrate layer depends on many considerations, thus it may be of substantial thickness. For example, over 3,000 μm, or of minimum thickness providing there are no significant adverse effects on the substrate. In embodiments, the thickness of the substrate is from about 75 μm to about 300 μm.

The photoreceptor further comprises a charge generating layer comprised of a binder polymeric resin material or film including particles, or resin layers and a photogenerating pigment such as vanadyl phthalocyanine, metal phthalocyanines metal free phthalocyanine, hydroxygallium phthalocyanine, benzimidazole perylene, amorphous selenium, trigonal selenium, selenium alloys such as selenium-tellurium, selenium-telluriumarsenic, selenium arsenide, chlorogallium phthalocyanin, and the like, and mixtures thereof. The photogenerating pigments may be dispersed in an optional binder, such as a resinous binder, in an amount of from about 0 percent by weight to about 95 percent by weight, alternatively from about 25 percent to about 60 percent by weight of the charge generating layer. Suitable polymeric films forming binder materials include, but are not limited to thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, amino resins phenylene oxide resins, terephthalic acid resins, phenoxy resins, epoxy resins, phenolic resins, polystyrene and acrylonitrile copolymers, polyvinyl chloride, vinylchloride and vinyl acetate copolymers, acrylate copolymers, alkyd resins, cellulosic film formers, poly(amideimide), styrene-butadiene copolymers, vinylidinechloride-vinylchloride copolymers, vinylacetate-vinylidenechloride copolymers, vinylacetate-vinylidenechloride copolymers, styrene-alkyd resins, polyvinylcarbazole, and the like, and mixtures thereof. The charge generating layer may comprise pigments and these pigments can be applied by various techniques including, vaporization, sputtering, spraying and dipping. The charge generating layer may be a thickness of from about 0.05 μm to about 10 μm, alternatively from about 0.25 μm to about 2 μm, for example, when photogenerating material is present in an amount of from about 30 percent to about 75 percent by volume.

The charge transport layer transports charge from the charge generating layer. It may comprise electrically active organic resin materials such as polymeric arylamine compounds and related polymers, including polysilylenes such as poly(methylphenyl silylene), poly(methylphenyl silylene-co-dimethyl silylene), poly(cyclohexylmethyl silylene), polyvinyl pyrenes and poly(cyanoethylmethyl silylene), and multifunctional acrylate compounds such as described in U.S. Pat. No. 6,800,411. The charge transport layer may also comprise hole transport molecules, such astriphenylmethane, and aromatic amine compounds including, arylamines, enamines, hydrazones, and the like including other known charge transports. For example, a compound such as an arylamine

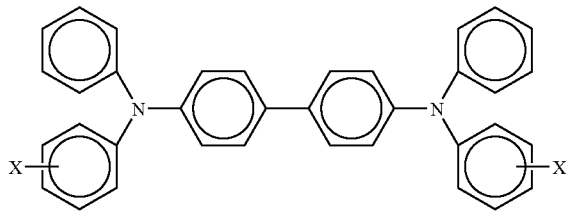

wherein X is selected from the group consisting of alkyl and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; the charge transport layer may also comprise metal phthalocyanines, or metal free phthalocynanines; titanyl phthalocynanines, perylenes, alkylhydroxygallium phthalocyanines, hydroxygallium phthalocyanines, or mixtures thereof; of Type V hydroxygallium phthalocyanine. The thickness of the charge transport layer may be from about 2 μm to about 100 μm, from 5 μm to about 50 μm, or from about 10 μm to about 30 μm, and can be applied by similar techniques as those used for applying the charge generating layer, such as spraying, dipping, spin and roller coating. The charge generating layer may contain from about 10 percent to about 75 percent by weight of charge transport material, or alternatively from about 35 percent to about 50 percent of transport material.

The photoreceptor may also comprise an overcoat layer to primarily protect the charge transport layer and increase resistance to abrasion, and this layer ranges in thickness of from about 1 μm to about 10 μm or from about 3 μm to about 7 μm. The overcoat layer is comprised of a material which is electrically insulating or semiconductive such as thermoplastic organic polymers or inorganic polymers, for example, silicon, silicon containing aromatic materials, polyester resin and other components such as copolyester-polycarbonate resin or polycarbonate, or polycarbonate mixtures, polyvinyl acetate, and polyacrylate. The overcoat layer may have, for example, a thickness from about 1 μm to about 5 μm, in certain embodiments from about 2 μm to about 4 μm, and in other embodiments from about 1 μm to about 2 μm.

The undercoat layer of the photoreceptor can comprise one or more layers wherein at least one layer contacts the surface of the substrate and at least one layer comprises an anti-corrosion layer. The anti-corrosion layer may be applied using various techniques. In embodiments, the anti-corrosion layer comprises an anodized layer of a metal or a metal alloy, such as anodized aluminum and titanium oxide, which can be applied by anodization techniques using inorganic or organic acids such as sulfuric acid, oxalic acid, chromic acid, phosphoric acid, sulfamic acid, and benzenesulfonic acid. The anodized layer of the undercoat may have a thickness of from about 0.001 μm to about 0.1 μm, or from about 0.005 μm to about 0.050 μm, or from about 0.010 μm to about 0.030 μm.

Other layers comprising the undercoat layer may include one or more layers with hole blocking properties. Such hole blocking materials may comprise materials including nitrogen containing siloxanes and nitrogen containing titanium compounds, metal oxides such as titanium dioxide and zinc oxide, polymers such as, polyvinyl butyral, epoxy resins, polyesters, polysiloxanes, polyamides, polyurethanes, and the like. The nitrogen-containing siloxane and nitrogen-containing titanium compounds, include, trimethoxysilyl propyl ethylene diamine, N-beta(aminoethyl) gamma-aminopropyl trimethoxy silane, isopropyl 4-aminobenzene sulfonyl titanate, di(dodecylbenzene sulfonyl)titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, and gamma-aminopropyl trimethoxy silane.

The one or more layers of the undercoat can have a thickness of up to about 2 μm depending on the type of material used. Alternatively, the thickness of the undercoat can be from about 0.001 μm to about 0.5 μm since for example, greater thickness may lead to undesirably high residual voltage, or from about 0.005 μm to about 0.3 μm, or from about 0.03 μm to about 0.06 μm.

In another embodiment, a process is provided which comprises forming or applying an undercoat layer onto an electrophotographic photoreceptor which undercoat layer comprises one or more layers, wherein at least one layer of the undercoat layer is an anti-corrosion layer. The anti-corrosion layer can be applied by various techniques, for example, by anodization of the surface of the substrate to yield, for example, a metal oxide surface, by passivating the surface of the substrate or by chemical treatment of the surface of the substrate. Several such techniques are described in more detail below.

FIG. 1, is a diagram of an embodiment, wherein the substrate 10 is coated with an anti-corrosion layer (ACL) for example, an anodized metal film 12 is formed or applied on a substrate 10, and a layer 14 with hole blocking properties is applied on the anti-corrosion layer 12 to form the undercoat layer. The substrate 10 may be made of aluminum, aluminum alloy, or an electrically conductive or insulating substance other than aluminum. Other layers of the photoreceptor such as a charge generating layer 16, a charge transport layer 18 and an overcoat 20 are also present in the photoreceptor illustrated in FIG. 1.

In conductive substrates such as aluminum, the anodizing process generates an anti-corrosion layer on the surface of the substrate, for example, anodized aluminum. The substrate can be of various sizes and types, for example, commercially available substrates such as aluminum alloys with industry designations 6063, 3003, 6061, 1Q70, and 1050 can be anodized using several different systems operating at different process parameters. In one embodiment, the counter electrode or cathode can be made of a titanium mesh and the fixture holding the substrate can also be made of titanium.

In the anodizing process, an electrolyte is used such as an acid, including, inorganic acids such as sulfuric, chromic, phosphoric acids, and organic acids such as oxalic, sulfamic, and benzene sulfonic acid. The electrolyte is comprised of from about 5% to about 20% (v/v), or from about 10% to about 15% (v/v) of the acid, for example, sulfuric acid, and the process can be operated at a reduced temperature, for example, of from about 0° C. to about 30° C., or from about 10° C. to about 20° C. The process can also be performed at a current density of about 50 to 75 amps/dm2 until a stable voltage is obtained or from about 5 minutes to about 7 minutes at the highest temperature and from about 1 minutes to about 1.5 minutes at the lowest temperature. The voltage attained stabilized at about 15 volts at the highest temperature and at about 22 volts at the lowest temperature. After anodizing, the anodized substrates are rinsed with flowing deionized water.

The anodizing process may comprise holding the aluminum substrate with a device fabricated out of, for example, a metal such as titanium or aluminum of the same alloy or metal as the photoreceptor substrate, and submerging the substrate device in the electrolyte. A counter electrode is placed in the electrolyte at a distance of about less than one to about several centimeters from the substrate to be anodized. For example, if the substrate is made of aluminum, the counter electrode is fabricated from, for example, titanium. The aluminum is made to be positive while the counter electrode is made to be negative. A voltage of from about less than 1 to about more than 100 volts is applied for a predetermined time, for example, from less than 1 minute to about more than 30 minutes. While it is not necessary to cause the electrolyte to circulate during the anodizing process, circulation of the acid helps maintain uniform temperature, thus, uniform aluminum oxide characteristics, for example, uniform thickness, uniform structure, and uniform dielectric strength can be achieved on the anodized layer. The system can be run with either voltage or amperage control. A direct current power supply of the size required for a specific anodization process can be used to provide the necessary voltage and amperage. After the desired conditions, for example, stable voltage, have been met, the anodized aluminum substrate is removed from the electrolyte and rinsed in deionized water. A subsequent sealing step can be used after rinsing. Sealing may be done by submerging the anodized device into a boiling bath of, for example, dilute nickel acetate or deionized water, followed by rinsing the device after boiling.

The anodizing process may also clean the aluminum substrate by removing metal alloy, for example, aluminum alloy constituents and impurities if an aluminum substrate is used. In this embodiment, alloy constituents that become soluble ions in an anodic situation, for example, Fe, Mg, Zn, Mg, and Cu, are removed from the substrate surface to a considerable depth from about 1 μm to many microns. Other constituents, for example, films of oil, are also removed by the action of the oxygen gas that is formed at the surface of the device being anodized.

The anodizing process for forming the anti-corrosion layer provides a layer of high dielectric strength on the surface of the device such as a drum. The remaining layers of the undercoat can then be coated on top of the anti-corrosion layer, followed by other layers of the photoreceptor. The combined effect of the surface protection provided by the treatment process in addition to the protection provided by an undercoat coated layer enables longer electrical life to the devices produced by this method.

Alternatively, the anti-corrosion layer of the undercoat layer can be provided to the substrate by coating the surface of the substrate with an anti-corrosion solution. In this embodiment, the solution forms an anti-corrosion layer on the substrate, and may be a conducting layer which can be comprised of materials such as a conductive polymer layer, conductive layer containing semiconductor particles, a doped polymer layer comprising surface treated particles such as transport molecules and electron transporting polymers, or other surface modifications to achieve efficient electron transport at the anti-corrosion layer-substrate interface and/or anti-corrosion layer-next undercoat layer interface and to provide increased substrate protection. In this embodiment, the substrate surface can be passivated or chemically treated prior to applying the anti-corrosion layer.

Alternatively, substrate protection can also be provided by coating the substrate with a solution to form a coat on the surface of the device. In this embodiment, the coating solution forms a coating layer which can be a conducting layer and may be comprised of a conductive polymer layer, a conductive layer comprising semiconductor particles, a doped polymer layer containing electron transport molecules such as a carboxyfluorenone malonitrile (CFM) derivatives represented by the general structure:

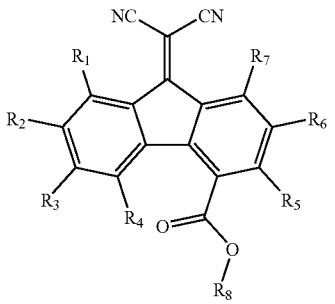

wherein each of $R_1$, $R_2$, $R_3$, $R_4$, $R_5$, $R_6$, $R_7$ and $R_8$ is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, a doped polymer layer containing hole transport molecules for positively charged devices, or a doped polymer layer containing surface treated particles such as transport molecules or electron transporting polymers, or other surface modifications to achieve efficient transport at the anti-corrosion layer—substrate interface, and/or the anticorrosion layer—undercoat/hole blocking layer interface. The anti-corrosion layer provides increased substrate protection.

EXAMPLE 1

Anodized substrates prepared at 25° C. An aluminum substrate was used in these Examples. The substrate was attached to two electrodes, with the counter electrode or cathode comprising a titanium mesh and the fixture holding the substrate comprising titanium. The substrate was then submerged in an electrolyte solution composed of 15% (v/v) sulfuric acid and the process was operated at a reduced temperature, 25, 20, 15, 10 and 5° C. The anodization process was operated at a current density of 75 amps/dm$^2$ until a stable voltage was obtained which was reached at about 5 to 7 minutes at the highest temperature of about 25° C. during operation and at about 1 to 1.5 minutes at the lowest temperature of about 5° C. of the run. The voltage attained stabilized at 15 volts at the highest temperature and at 22 volts at the lowest temperature. After anodizing, the substrate was rinsed with flowing deionized water. Using the above anodization conditions, six substrates were anodized at each of the five temperatures, i.e., 25° C., 20° C., 15° C., 10° C. and 5° C.

After the anodization of the substrates, a subsequent layer of an undercoat of about 1 μm to 2 μm in thickness was applied to the anodized layer on the substrate. This layer (HiTi, UCL) was comprised of titanium dioxide, a phenolic resin, bisphenol S, and silicon dioxide in a mixed solvent of xylene and butanol ($TiO_2/SiO_2$/VARCUM™/bisphenol S with a weight ratio of about 52.7/3.6/34.5/9.2 and a thickness of 3.5 μm) was then dip-coated onto the substrate at a pull rate of 160 millimeters/minute, and after curing at 160° C. for 15 minutes. A charge generating layer (CGL) based on 3 parts of chlorogallium phthalocyanine Type B (PC5) or 3 parts of hydroxygallium phthalocyanine Type V (PC7) and a vinyl chloride/vinyl acetate copolymer, VMCH™ (a vinyl resin comprising $M_n$ equal to 27,000, about 86 weight percent of vinyl chloride, about 13 weight percent of vinyl acetate and about 1 weight percent of maleic acid, available from Dow Chemical) in 95 grams of toluene/n-butylacetate with a weight ratio of 2 to 1, was then applied onto the undercoat layer. A charge transport layer (CTL) was then coated onto the charge generating layer from a solution comprising 8.8 parts of N,N'-diphenyl-N,N-bis(3-methyl phenyl)-1,1'-biphenyl-4,4'-diamine and 13.2 parts of the polycarbonate, PCZ-400 [poly(4,4'-dihydroxy-diphenyl-1-1-cyclohexane, $M_w$ equal to 40,000)] from Mitsubishi Gas Chemical Company, Ltd. in a mixture of 55 grams of tetrahydrofuran (THF) and 23.5 grams of toluene. The CTL was dried at 120° C. for 45 minutes.

Figure 2:
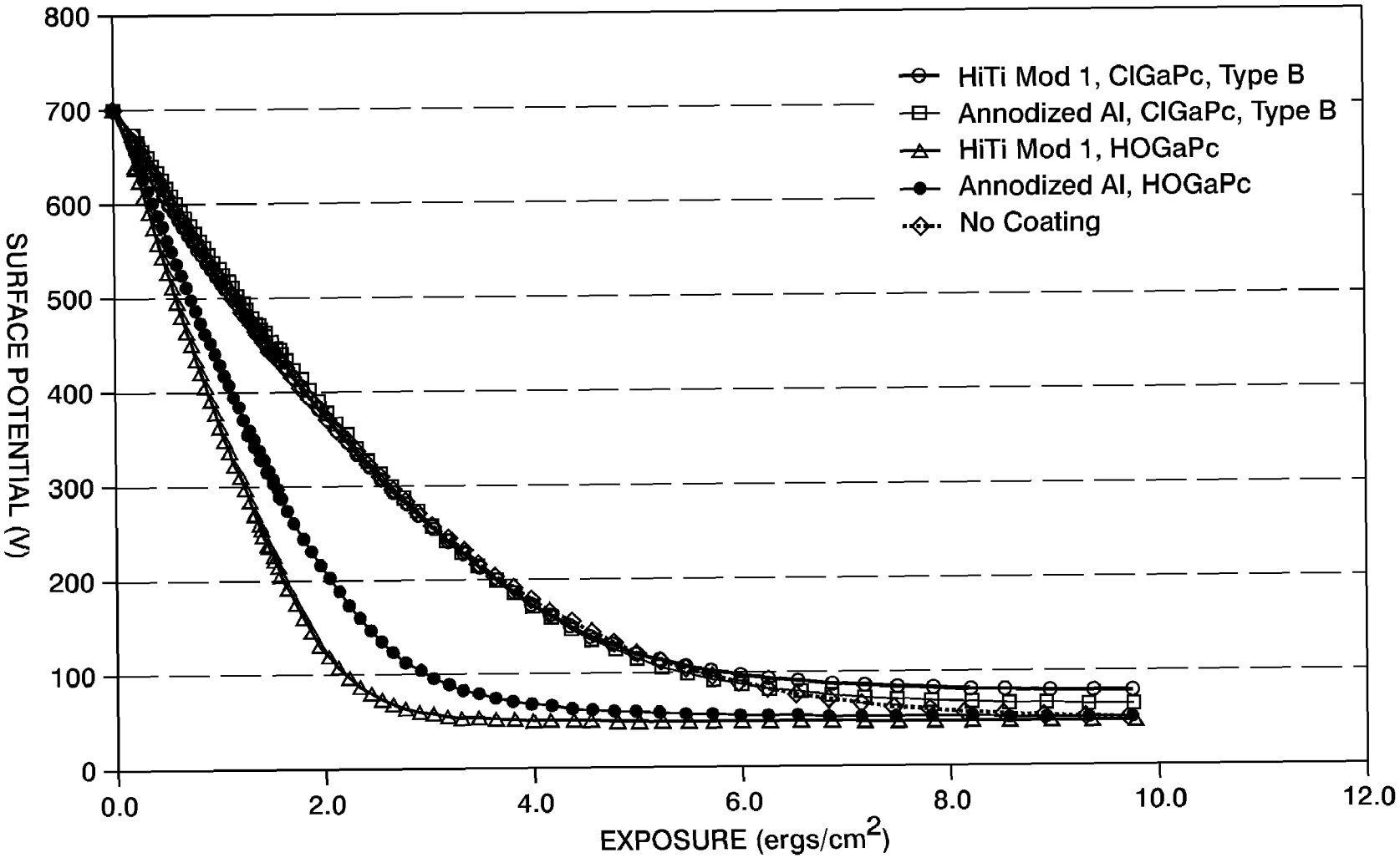
FIG. 2 is a graph showing the electrical characteristics of photoreceptor devices with an UCL having an anodized layer in the presence or absence of a hole blocking layer compared to a prior art device.

For comparison, photoreceptor devices without an undercoat layer were also prepared by directly coating CGL and CTL onto the substrates. Electrical performance of the photoreceptors was measured with an electrical scanner set to obtain photoinduced discharge cycles (PIDC), sequenced at one charge-erase cycle followed by one charge expose-erase cycle, wherein the light intensity was increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 700 volts with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.). The data were analyzed and plotted as the photo-induced discharge characteristics (PIDC) curves of the devices and are shown in FIG. 2. A PHASER 7700 production drum was used for comparison to commercially available photoreceptors.

FIG. 2 shows the PIDC curves of representative devices. All devices represented in FIG. 2, except for Phaser 7700 (p7700), contained an anodized aluminum substrate and a standard 24 μm charge transport layer. Device 550SD contained a 1.5 μm undercoat layer (HiTi UCL) and PC5 charge generating layer (PC5 CG, large closed circles). Device 551 SD contained a PC5 CG, but no undercoat layer (open squares). Device 552SD contained a 1.5 μm HiTi UCL and PC7 CG (closed triangles), and Device 553SD had a PC7 CG, but no UCL (small closed circles). The results showed that higher depletion and dark decay were generally observed for devices without an undercoat layer, for example, Phaser 7700. However, for devices having an anodized layer with an undercoat, the electrical characteristics are similar to that of nominal devices. Cyclic data also indicated good stability for devices having an anodized undercoat layer.

As illustrated in FIG. 2, similar sensitivity and shape were observed for devices with or without UCL when using PC5 CGL. In contrast, for PC7 CGL, significantly lower sensitivity was seen in the device without a UCL than the device with a 1.5 μm HiTi UCL. The PC7 CGL device has a sensitivity of 257 Vcm$^2$/ergs and the latter 333 Vcm$^2$/ergs, a 30% difference over the device without the additional undercoat layer. Both devices were coated at the same pull rate for the CGL and it appears that either the PC7 CG is coated thinner on the anodized substrate or a quenching might have occurred between the PC7 CG and substrate. The lack of any sensitivity change observed with the PC5 devices may indicate that the devices may posses a thinner CG layer.

Table 1 below further illustrates typical electrical characteristics of the devices, including that of a Phaser 7700 production drum for experiments performed at 25° C.

TABLE 1

| Device | dV/dX | VL(2.0) | VL(4.5) | Verase | Vdep | DDR at 20 nC/cm2 (V/s) | DDR at 100 nC/cm2 (V/s) |
|---|---|---|---|---|---|---|---|
| PC5 with 1.5 μm HiTi UCL | 179 | 371 | 139 | 71 | 51 | 137 | 323 |
| PC5 with no UCL | 150 | 379 | 135 | 60 | 108 | 284 | 432 |
| PC7 with 1.5 μm HiTi UCL | 333 | 118 | 49 | 47 | 81 | 210 | 339 |

TABLE 1-continued

| Device | dV/dX | VL(2.0) | VL(4.5) | Verase | Vdep | DDR at 20 nC/cm2 (V/s) | DDR at 100 nC/cm2 (V/s) |
|---|---|---|---|---|---|---|---|
| PC7 with no UCL | 257 | 202 | 61 | 54 | 66 | 214 | 460 |
| Std. Phaser 7700 drum | 178 | 371 | 143 | 44 | 55 | 139 | 236 |

Table 1 shows that the columns represented by VL (2.0) and VL (4.5) are surface potential of a device at exposure energy of 2.0 and 4.5 ergs/cm$^2$, respectively. Dark decay rate (DDR) represents the rate of dark decay of the photoreceptor measured in units of volts/second (V/s) at certain charge density. As demonstrated in Table 1, the data show that the devices without an additional undercoat layer (no UCL) show an increased dark decay rate over the devices containing additional undercoat layers (HiTi UCL) or hole blocking layers.

It will be appreciated that various of the above-disclosed and other features and functions, or alternatives thereof, may be desirably combined into many other different systems or application. Also, that various presently unforeseen or unanticipated alternatives, modifications, variations, or improvements therein may be subsequently made by those skilled in the art which are also intended to be encompassed by the following claims.

What is claimed is:

1. A process for manufacturing a photoreceptor, the process comprising:

applying to a supporting substrate layer of the photoreceptor, in sequence, an anti-corrosion layer, an undercoat layer, a charge generating layer, and a charge transport layer, wherein the anti-corrosion layer is provided at an interface between the substrate layer and the undercoat layer, and wherein the anti-corrosion layer comprises a doped polymer layer comprising electron transport molecules or derivatives thereof represented by the general formula:

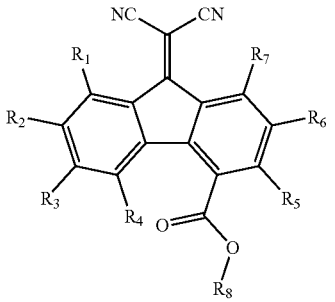

wherein each $R_1$, $R_2$, $R_3$, $R_4$, $R_5$, $R_6$, $R_7$ and $R_8$ is independently selected from the group consisting of hydrogen, alkyl having 1 to 40 carbon atoms, alkoxy having 1 to 40 carbon atoms, phenyl, substituted phenyl, napthalene, anthracene, alkylphenyl having 5 to 40 carbons, alkoxyphenyl having 8 to 40 carbons, and aryl having 6 to 30 carbons and optionally substituted with halogen.

2. A process in accordance with claim 1, further comprising applying the anti-corrosion layer is by anodizing the surface of the supporting substrate.

3. A process in accordance with claim 2, wherein anodizing the surface of the supporting substrate comprises:

submerging the substrate in an electrolyte solution comprising an acid of from about 5% to about 20% (v/v) of the electrolyte solution along with a titanium and/or aluminum source;

placing a counter electrode in the electrolyte solution; and applying a voltage across the electrolyte solution for a predetermined length of time and at a temperature of from about 0° C. to about 30° C.

4. A process in accordance with claim 3, wherein the acid is selected from the group consisting of: sulfuric, phosphoric, chromic oxalic, sulfamic, and benzene sulfonic acid.

5. A process in accordance with claim 2, wherein anodizing is performed at a current density of about 50 to about 75 amps/dm$^2$.

6. A process according to claim 1, wherein the charge transport layer comprises at least one compound selected from: arylamine, enamine, and hydrazone, the arylamine having the formula:

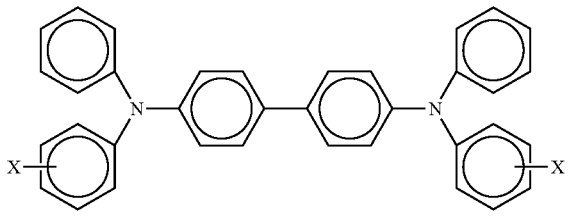

wherein x is selected from the group consisting of alkyl and halogen, and wherein the aryl amine is dispersed in a resinous binder.

7. A process according to claim 6, Wherein the charge generating layer comprises at least one of: vanadyl phthalocyanine, metal phthalocyanines, metal-free phthalocyanine, hydroxygallium phthalocyanine, benzimidazole perylene, amorphous selenium, trigonalselenium, selenium-tellurium, selenium-telluriumarsenic, selenium arsenide, chlorogallium phthalocyanin, and mixtures thereof.

* * * * *